United States Patent [19]

Freeman, Jr.

[11] 4,026,659

[45] May 31, 1977

[54] COOLED COMPOSITE VANES FOR TURBINE NOZZLES

[75] Inventor: William R. Freeman, Jr., North Muskegon, Mich.

[73] Assignee: Avco Corporation, Stratford, Conn.

[22] Filed: Oct. 16, 1975

[21] Appl. No.: 622,847

[52] U.S. Cl. ..... 415/115; 415/116; 415/214

[51] Int. Cl.[2] ..... F01D 5/08

[58] Field of Search ..... 415/115, 116, 117, 241, 415/214; 416/96, 97, 224, 95, 96; 29/156.8 H, 156.8 B

[56] References Cited

UNITED STATES PATENTS

| | | | |
|---|---|---|---|
| 2,220,420 | 11/1940 | Meyer | 29/156.8 H |
| 2,585,871 | 2/1952 | Stalker | 415/116 |
| 3,166,295 | 1/1965 | Szewalski et al. | 29/156.8 B |
| 3,211,423 | 10/1965 | Gilbert | 415/117 |
| 3,430,898 | 3/1969 | Parechanian et al. | 416/224 |
| 3,486,833 | 12/1969 | Miller et al. | 416/224 |
| 3,533,711 | 10/1970 | Kercher | 415/116 |
| 3,600,781 | 8/1971 | Scott | 29/156.8 B |
| 3,619,077 | 11/1971 | Wile et al. | 415/115 |
| 3,650,635 | 3/1972 | Wachtell | 415/115 |
| 3,844,728 | 10/1974 | Copley et al. | 416/241 B |

FOREIGN PATENTS OR APPLICATIONS

| | | | |
|---|---|---|---|
| 1,151,368 | 1/1958 | France | 415/115 |
| 1,601,563 | 7/1970 | Germany | 415/115 |
| 647,143 | 12/1950 | United Kingdom | 415/115 |
| 760,734 | 11/1956 | United Kingdom | 415/115 |

*Primary Examiner*—Henry F. Raduazo
*Attorney, Agent, or Firm*—Charles M. Hogan; Irwin P. Garfinkle; Peter Kent

[57] ABSTRACT

A turbine nozzle has inner and outer shrouds structurally connected by hollow core members which together with nose and tail inserts retained in the shrouds form airfoil-shaped vanes. Openings in one of the shrouds supply cooling air to the hollow vane cores whose walls have orifices to impinge air upon the inserts. Spent air from the nose insert film cools the core. Air directed at the tail insert divides to flow through holes in the insert and to film cool the insert. Orifices and holes are cast or readily drilled into the parts prior to their assembly. For superior resistance to high temperatures, the inserts are preferably columnar-grained or monocrystalline superalloy castings which are brazed or welded into the shrouds and are replaceable to extend nozzle service life. Alternatively, ceramic or metal inserts are mechanically retained in the shrouds.

7 Claims, 3 Drawing Figures

COOLED COMPOSITE VANES FOR TURBINE NOZZLES

BACKGROUND OF THE INVENTION

This invention relates to fluid directing elements for turbines, in particular to nozzles for high temperature gas turbine engines.

In each turbine stage of a gas turbine engine, a nozzle directs and accelerates hot pressurized combustion gas into a bladed wheel to perform work upon the blades. Nozzles comprise an annular array of fluid directing, airfoil shaped vanes fixed at their ends to inner and outer shrouds. since the first stage turbine nozzle directs the gas immediately emerging from the combustor it is exposed to the most extreme temperatures and requires highly sophisticated materials and thermal and structural design. In high temperature engines, the nozzles in the first one or two turbine stages are not only cast from the most temperature resistant superalloys available, but are also cooled by air flowing in passages within the vanes and by air dispersed over the exterior surfaces of the vanes and the shrouds. The nose and tail of a vane airfoil are most intensely heated by the flowing hot gas and consequently are designed to receive the strongest cooling.

Cooling of a vane nose is often accomplished by casting a hollow vane and positioning within the hollow an insert from which compressed air impinges upon the interior of the vane nose. The spent impingement air is ducted within the hollow around the insert and discharged through holes in the vane walls and vane tail to film cool the exterior surfaces of the vane. The assembly and sealing of the insert into the vane hollow and the drilling of the film cooling holes are costly operations.

A conventional method of nozzle fabrication is to cast the vanes separately and then braze, weld or mechanically fasten them to the inner and outer shrouds. Brazing, the cheapest attachment method, is structurally weak. Conventional welding is not much stronger, and electron beam welding is very costly. Mechanical retention of the vanes in the shrouds is also costly and produces a heavy design.

Integral casting of the vanes and shrouds is a commonly used method of fabrication which solves many of the vane attachment problems but limits casting process flexibility and cooling configuration complexity. Also, in an integral casting, some locations on the vanes where cooling holes are desirable are inaccessible to drilling owing to interference from adjacent vanes.

The significant increase in gas turbine efficiency and power obtainable with increasing turbine inlet temperature has spurred considerable effort over the years to develop turbines capable of accepting higher temperatures. Most of the effort has been directed toward improving the high temperature properties and cooling of metallic turbine hardware such as nozzles. New processes have been developed recently which, through unidirectional solidification of superalloy castings, produce columnar-grained material with high temperature properties improved over conventionally cast, equiaxed-grain material. A process has also been demonstrated for the casting of monocrystalline turbine elements which are still more superior in high temperature properties. However, the casting of integral nozzles using these new and costly processes is not economically because the intricacy of an integral nozzle makes it inherently subject to many casting defects and high scrappage rates.

Recently, interest has heightened in employing ceramics in gas turbines. The high temperature capabilities of ceramic materials are very attractive, but the brittleness, the poor tensile strength, and the problems of mating these materials to metal have prevented their use to date.

An object of my invention is a gas turbine nozzle with longer life, higher temperature capability and reasonable fabrication cost.

Another object is a gas turbine nozzle configured so that materials with superior high temperature properties can be practically and economically utilized, particularly in those areas where current nozzle configurations experience impairment from the high temperature fluids they direct.

Another object is a nozzle which can be readily and inexpensively provided in desirable locations with holes and passages for cooling air.

Still another object is a nozzle in which those portions most intensely heated and subject to damage are replaceable to restore the utility of the nozzle.

SUMMARY OF THE INVENTION

The objects of this invention are achieved in a turbine nozzle with inner and outer shrouds structurally connected by hollow members each of which is a vane core. The vanes are completed by appropriately shaped nose and tail inserts retained in the shrouds in spaced relation to the cores so as to form complete airfoils.

The composite vane structure lends itself to air cooling. In one of the shrouds are openings to supply cooling air to each of the hollow cores whose walls have orifices to impinge the air upon the inserts. The nose insert is shaped to direct spent impingement air over the core for film cooling. Air directed at the tail insert is divided to flow through holes in the insert and to film cool the insert. The orifices and holes are cast or are readily drilled into the parts prior to their assembly.

The shrouds and cores are simple geometries which are integrally cast using conventional methods. Alternatively, the cores are brazed or welded to the shrouds. For superior resistance to high temperature, the inserts are columnar-grained or monocrystalline superalloy castings, preferably bonded to the shrouds as by brazing or welding. During engine use of the nozzle, the braze or weld may crack locally but will still retain the inserts in position. Air leakage through the cracks will be small and will merely supplement shroud film cooling air introduced upstream. The inserts can be cut out and replaced when required. Alternatively, ceramic or metal inserts mechanically retained in the shrouds are used.

The superior temperature resistance of the ceramic, columnar or monocrystalline superalloy inserts, the efficient cooling arrangement facilitated by the use of inserts and finally the replaceability of the inserts themselves, result in a nozzle capable of very long service life. Eliminated is the costly, commonly used, impingement insert positioned within a hollow in the vane. It will be apparent that either the nose or the tail inserts described as separate inserts could be integrally cast with the core portion of the vane and still achieve many of the objects of this invention. Also, the cores may have more than one internal passage for increased internal cooling.

In gas turbine engines, a temperature peak in the gas entering the first turbine stage, considerably exceeding the average gas temperature, is sometimes found to occur at a constant circumferential location. The peak may originate from fixed and unimprovable characteristics of the burner. In such a situation the first stage turbine nozzle requires superior high temperature resistance only at a single vane, or at the several vanes located in the temperature peak. Consequently a nozzle, to reduce cost, could be manufactured with only one, or several vanes constructed according to this invention. The remainder of the vanes could be of any other, more conventional construction, such as a cast airfoil having a single spanwise internal passage through which cooling air flows.

DETAILED DESCRIPTION OF THE INVENTION

Figure 2:
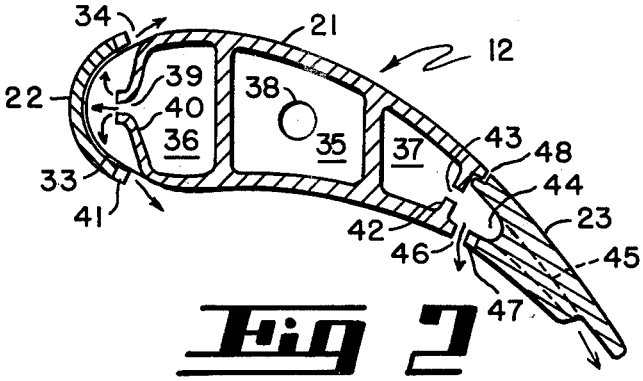
FIG. 2 is a cross section through the vane shown in FIG. 1 taken on line 2—2.
Figure 1:
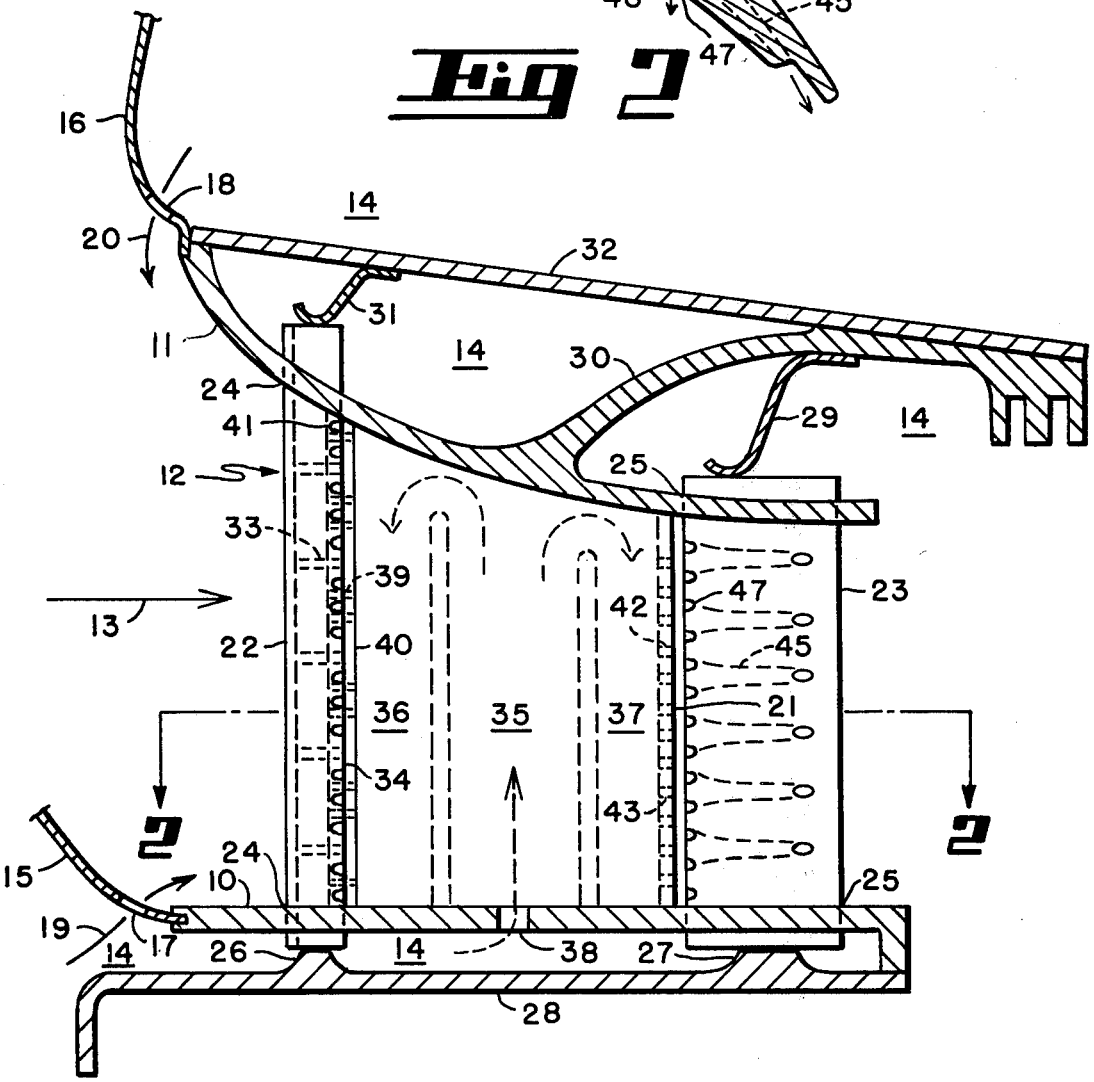
FIG. 1 is a cross section through the shrouds of a turbine nozzle and shows a sideview of a vane.

Referring now to FIG. 1 and FIG. 2, a portion of a turbine nozzle embodying my invention is shown. An inner shroud 10 and outer shroud 11 retain a plurality of vanes 12 (of which only one is shown) in an annular array thereby defining a plurality of channels to direct the flow of hot combustion gas 13. Surrounding the nozzle, contacting those surfaces not exposed to the hot gas flow 13, is compressed air (generally indicated by reference character 14) at a somewhat higher pressure. In the inner flow guide 15 and outer flow guide 16, which respectively mate with the upstream ends of the nozzle shrouds 10 and 11, circumferentially spaced holes 17 and 18 provide air flows 19 and 20 to film cool the shrouds 10 and 11 and the ends of the vane 12.

Each vane is comprised of a core 21, a nose insert 22 and a tail insert 23 which together form a complete airfoil. The vane cores 21 structurally retain the shrouds 10 and 11 and are preferable integrally cast with the shrouds 10 and 11. Alternatively, the cores 21 can be attached and sealed to the shrouds 10 and 11 by brazing or welding. In the shrouds 10 and 11 are slots 24 and 25 which hold the inserts 22 and 23 respectively in spaced relation to their associated core 21. The slots 24 and 25 are contoured to fit closely to the respective cross sections of the inserts 22 and 23 in order to minimize the leakage of air into the gas stream 13. Small leakages of air through the slots 24 and 25 are not detrimental in that the leakage will supplement the film cooling air 19 and 20 introduced upstream along the shrouds 10 and 11. The inner ends of the inserts 22 and 23 rest on individual pedestals 26 and 27 formed in a nozzle inner support member 28 attached to the inner shroud 10. The outer end of each tail insert 23 is retained by a spring 29 fastened to a nozzle outer support member 30 which is integral with the outer shroud 11. The outer end of each nose insert 22 is retained by a spring 31 fastened to a secondary nozzle outer support member 32. Integral with the exterior forward wall of the vane core core 22 are a series of spanwise spaced ribs 33 which help to establish the spacing the nose insert 22 away from its associated core 21 creating a space 34.

Running spanwise inside the core 21 are a central passage 35, a forward passage 36 and a rearward passage 37, all interconnected at the outer end of the vane 12. Air enters the central passage 35 through a hole 38 in the inner shroud 10, flows into the forward passage 36 and passes through orifices 39 in the forward wall 40 of the forward passage 36 to impinge upon the nose insert 22. The spent impingement air disperses in and issues from the space 34 between the core 21 and the nose insert 22 to film cool the exterior surfaces of the core 21. The longitudinal edges of the nose insert 22 have notches 41 to facilitate the escape and dispersement of the air from the space 34.

Air from the center passage 35 also flows into the rearward passage 37 whose rearward wall 42 has orifices 43 which discharge the air into a cavity 44 formed by the rearward wall 42 and the tail insert 23. The orifices 43 are directed at passages 45 running rearward through the tail insert 23 allowing some of the cooling air to pass through. The remainder disperses in the cavity 44 and mostly passes through the opening 46 between the rearward wall 42 and the tail insert 23 on the concave side of the vane. The edge of the tail insert 23 along this opening 46 has a series of spaced notches 47 to facilitate the escape of this air and its dispersement over the concave side of the tail insert 23 for film cooling.

On the convex side of the vane 12 the forward edge of the tail insert 23 is scarfed to make a loose joint 48 with the rear edge of the core 21. This joint 48 passes but little of the air emanating from the rearward wall 42 of the rearward passage 37 even though the static pressure of the hot gas flow 13 along this portion of the vane 12 is relatively low. A large addition of air to the boundary layer flow along the rearward convex portion of a vane chord is detrimental to the aerodynamic performance of the nozzle.

Figure 3:
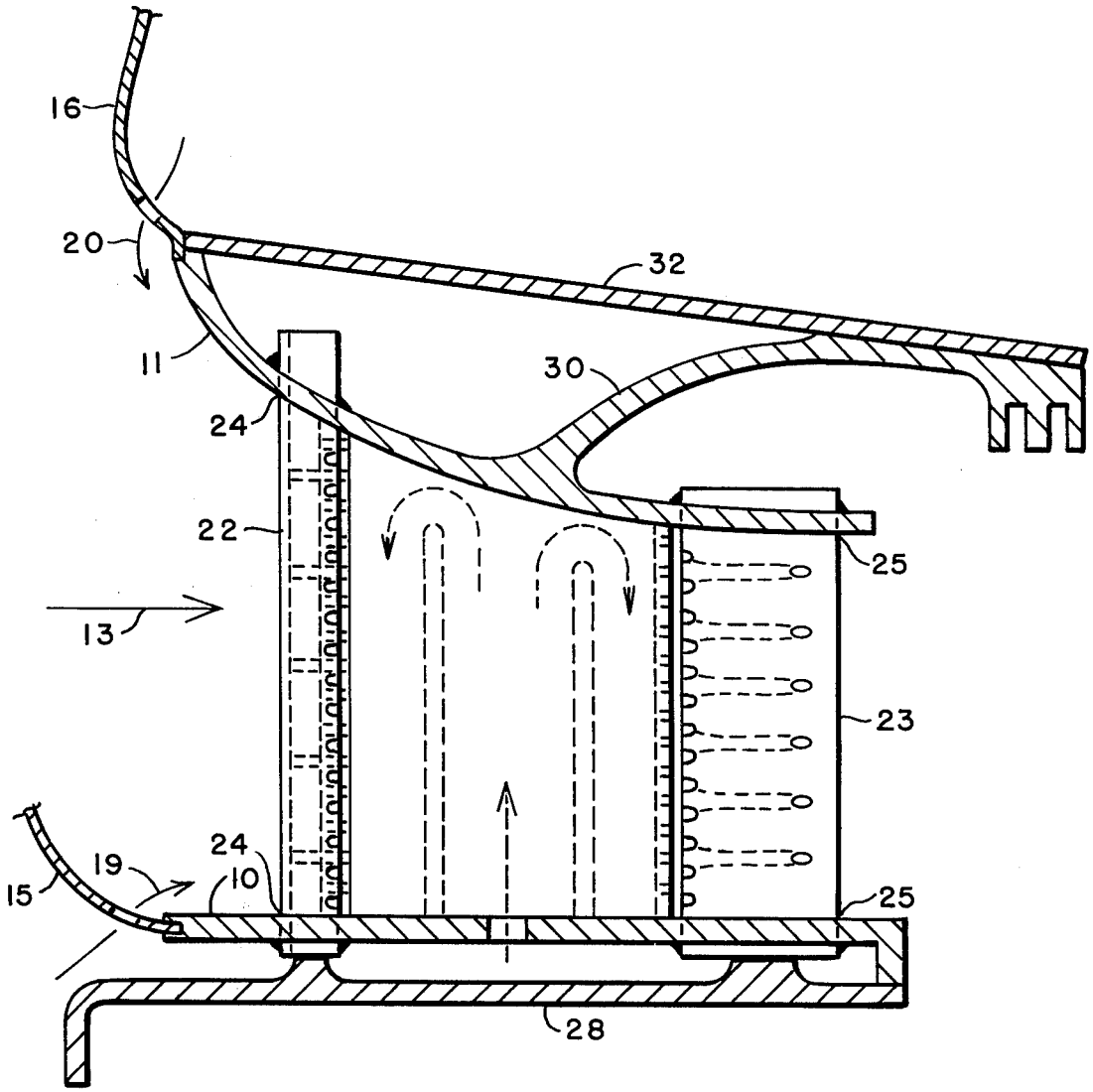
FIG. 3 is a cross section through the shrouds of a turbine nozzle and shows another embodiment of my invention.

The embodiment in FIG. 3 differs from the preceding only in that another means of retaining inserts is shown. Inserts 22 and 23, when metallic, are bonded as by welding or brazing to the shrouds 10, 11 at slots 24 and 25.

I claim:

1. A nozzle for a turbo-machine said nozzle comprising:

an inner shroud;

an outer shroud; and a plurality of spaced airfoils between said inner and outer shrouds, at least one of said airfoils comprising a core extending between and retaining said inner and outer shrouds, said core having an internal passage running spanwise, one of said shrouds having a cooling air inlet into said internal passage, said core having a cooling air outlet therethrough, al least one replaceable insert fabricated separately of said core and said shrouds and means for retaining said insert between said shrouds in spaced relation to and independently of said core, said insert being wedge shaped and forming a tail for said airfoil, said cooling air outlet comprising orifices through the rearward wall of said internal passage, said orifices being directed toward said tail insert, and said rearward wall and said tail insert being shaped and positioned relative to each other so as to define between them a cavity and a spanwise opening therefrom so that cooling air issuing from said orifices is dispersed in said cavity and issues through said opening to film cool an exteior surface of said tail insert.

2. The invention as in claim 1 wherein said means for retaining said insert comprises a bond between said insert and said shrouds.

3. The invention as defined in claim 1 wherein said tail insert also has cooling passages originating in the surface facing said core, said passages running rearward through said insert and carrying a portion of the cooling air issuing from said core.

4. The invention as defined in claim 1 wherein said insert additionally comprises a second insert having a generally sem itubular shape and forming a nose for said airfoil.

5. The invention as defined in claim 4 wherein said cooling air outlet comprises orifices through the forward and the rearward walls of said internal passage, said forward wall orifices being directed toward said nose insert to impinge cooling air thereon, and said nose insert is shaped to direct cooling air over an exterior surface of said core, said rearward wall orifices being directed toward said tail insert, and said rearward wall and said tail insert are shaped and positioned relative to each other so as to define between them a cavity and a spanwise opening therefrom so that cooling air issuing from said rearward wall orifices is dispersed in said cavity and issues through said spanwise opening to film cool an exterior surface of said tail insert.

6. The invention as defined in claim 5 wherein said tail insert also has cooling passages originating in the surface facing said core, said passages running rearward through said insert and carrying a portion of the cooling air directed at said tail insert.

7. The invention as defined in claim 1 wherein said means for retaining said insert comprises at least one of said shrouds having a slot laterally confining at least one end of said insert and yielding means longitudinally retaining said insert within said slot.

* * * * *

UNITED STATES PATENT OFFICE
CERTIFICATE OF CORRECTION

PATENT NO. : 4,026,659
DATED : May 31, 1977
INVENTOR(S) : William R. Freeman, Jr.

It is certified that error appears in the above-identified patent and that said Letters Patent are hereby corrected as shown below:

Col. 1, line 68, before "because" insert -- practical -- .

Col. 3, line 65, delete duplication of "core" ;

Col. 3, line 66, after "spacing" insert -- of -- .

Col. 4, line 56, (Claim 1, line 12) change "al" to -- at -- .

Col. 5, line 13, "sem itubular" should read
-- semitubular -- .

Signed and Sealed this
thirtieth Day of August 1977

[SEAL]

*Attest:*

RUTH C. MASON
*Attesting Officer*

C. MARSHALL DANN
*Commissioner of Patents and Trademark*